US007893559B2

(12) United States Patent
Petersen et al.

(10) Patent No.: US 7,893,559 B2
(45) Date of Patent: Feb. 22, 2011

(54) POWER DISTRIBUTION SYSTEM

(75) Inventors: Ethan Petersen, Union City, CA (US); Justin Dobbs, Union City, CA (US); Elmar Grom, Union City, CA (US)

(73) Assignee: Glacier Bay, Inc., Union City, CA (US)

( * ) Notice: Subject to any disclaimer, the term of this patent is extended or adjusted under 35 U.S.C. 154(b) by 176 days.

(21) Appl. No.: 12/379,582

(22) Filed: Feb. 25, 2009

(65) Prior Publication Data

US 2009/0218883 A1 Sep. 3, 2009

Related U.S. Application Data

(60) Provisional application No. 61/064,283, filed on Feb. 26, 2008.

(51) Int. Cl.
*H01H 47/00* (2006.01)

(52) U.S. Cl. ..... 307/30

(58) Field of Classification Search ..... 307/30–34; 361/56; 315/209 R
See application file for complete search history.

(56) References Cited

U.S. PATENT DOCUMENTS 4,544,981 A * 10/1985 Hakoopian ..... 361/93.7
4,725,784 A * 2/1988 Peled et al. ..... 324/427
5,513,061 A * 4/1996 Gelbien et al. ..... 361/63
5,973,419 A * 10/1999 Kruppa et al. ..... 307/131
7,042,743 B2 * 5/2006 Pidutti et al. ..... 363/89
7,138,729 B2 * 11/2006 Bailey ..... 307/45

* cited by examiner

*Primary Examiner*—Albert W Paladini
(74) *Attorney, Agent, or Firm*—Foley & Lardner LLP

(57) ABSTRACT

A power distribution system comprises a DC bus supplied by an electrical generator and a resistive load connected to the DC bus. A switching device connects to the DC bus and the load and is configured to periodically open the circuit between the resistive load and the DC bus for a reoccurring period of time. The switching device senses the load on the DC bus and changes the length of the period of time based on the sensed voltage.

12 Claims, 3 Drawing Sheets

POWER DISTRIBUTION SYSTEM

CROSS-REFERENCE TO RELATED PATENT APPLICATIONS

This application claims priority to and the benefit of U.S. Provisional Application No. 61/064,283, filed Feb. 26, 2008. The foregoing provisional application is incorporated by reference herein in its entirety.

BACKGROUND

The present disclosure relates generally to the field of power systems for a sailing vessel. More specifically, the disclosure relates to a power distribution system including a DC bus and an appliance with a resistive element powered by the DC bus.

Sailing vessels, for example, may generally include an on-board power system with a 240 volt direct current (DC) power bus. When the vessel is underway, the DC power bus is generally powered by an on-board DC generator. Electric appliances that are configured to operate on AC power may be applied to the DC bus through an inverter. It may be advantageous to couple an electric appliance that is configured to operate on AC power directly a DC bus.

SUMMARY

One embodiment of the invention relates to a power distribution system comprising a DC bus supplied by an electrical generator and a resistive load connected to the DC bus. A switching device connects to the DC bus and the load and is configured to periodically open the circuit between the resistive load and the DC bus for a reoccurring period of time. The switching device senses the load on the DC bus and changes the length of the period of time based on the sensed voltage.

Another embodiment of the invention relates to a power distribution system for a marine vessel comprising a DC bus supplied by an electrical generator or a rectified output from an AC power source. The DC bus is configured to supply power to an appliance including a resistive heating element. The appliance has an electromechanical switch including two contacts, wherein the electromechanical switch is designed to operate with an AC power supply. A switching device is connected between the DC bus and the appliance, wherein the switching device is configured to periodically open the circuit between the resistive load and the DC bus for a reoccurring period of time in order to quench an arc forming between the contacts of the electromechanical switch. The switching device senses the load on the DC bus and changes the length of the period of time based on the sensed voltage.

DETAILED DESCRIPTION

Figure 1:
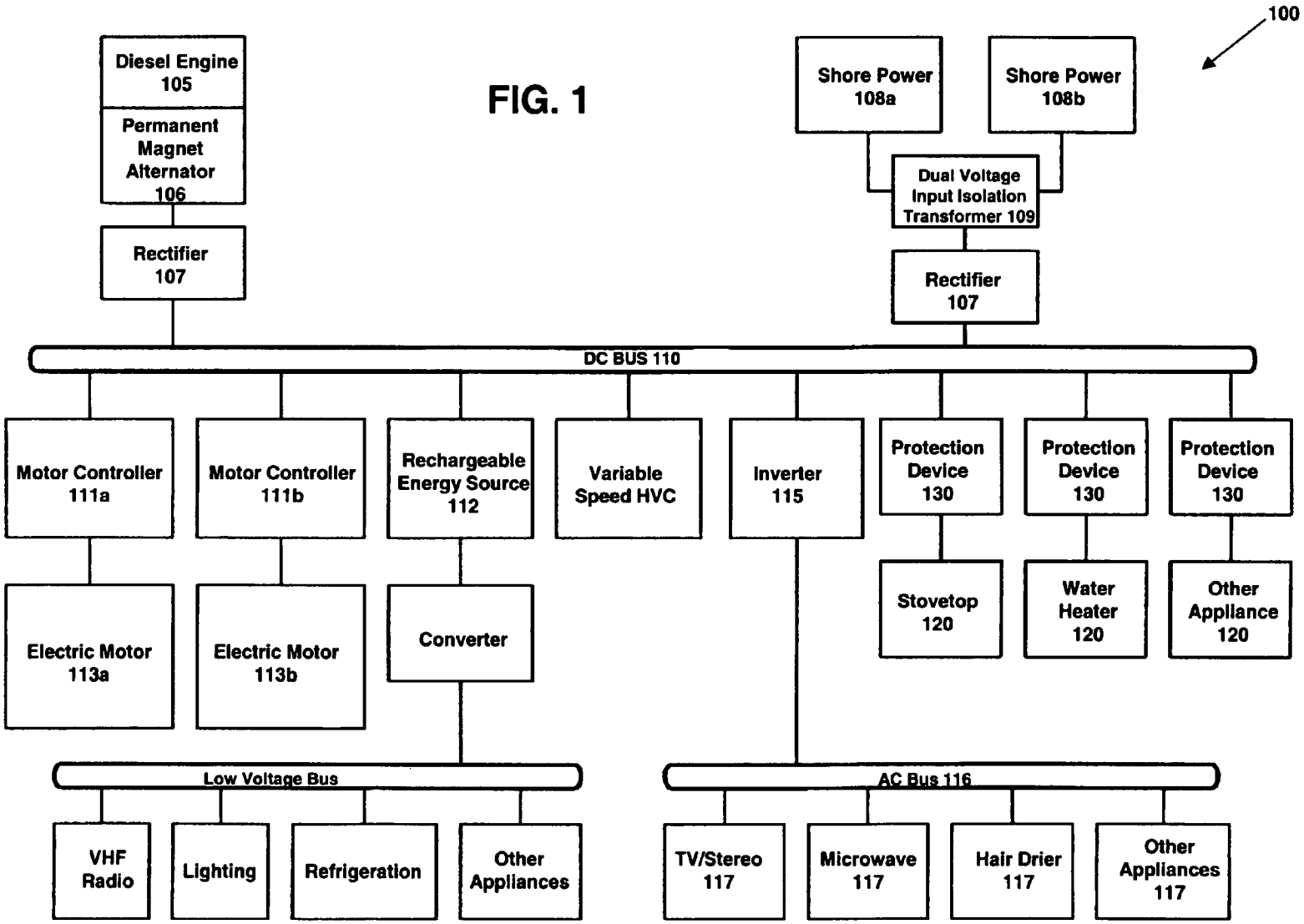
FIG. 1 is a block diagram of an electrical system for a sailing vessel according to one exemplary embodiment of the present invention.

Referring to FIG. 1, a block diagram of an electrical system 100 for a sailing vessel is shown according to exemplary embodiments. The sailing vessel includes an on-board power source to power a motor-driven propeller. According to an exemplary embodiment, power is supplied by a diesel engine 105 (preferably 40 HP) turning a permanent magnet alternator 106 (preferably 25 kW). The alternator 106 uses a rectifier 107 to power, for example, a DC bus 110 for the vessel. The voltage of the DC bus 110 is preferably 240V. As shown in FIG. 1, the vessel may include a high voltage rechargeable energy source 112, such as a battery bank, to store energy from the engine 105. The high voltage rechargeable energy source 112 source can be coupled to the DC bus 110. The electrical system 100 can be designed without the high voltage rechargeable energy source 112, as shown in FIG. 2 of U.S. Provisional Application No. 61/064,283.

An electric motor 113, such as a brushless DC permanent magnet motor, can be coupled to the DC bus 110 with a motor controller 111. As shown in FIG. 1, two electric motors 113*a* and 113*b* with differing levels of horsepower can be coupled to the DC bus 110 by motor controllers 111*a* and 111*b*. One of the motors 113 can drive a propeller (not shown). If the electrical system 100 includes a high voltage rechargeable energy source 112, one of the motors 113 may receive power from the high voltage rechargeable energy source 112 when the engine 105 and generator are turned off.

An inverter 115 may be coupled to the DC bus 110 to convert the 240 V DC power to provide power to, for example, a 120 V AC power bus 116. Various common appliances 117 such as televisions, microwaves, hair driers and other appliances may be coupled to the AC bus 116.

Some appliances 120 having a simple resistive heating element (e.g., water heaters, stovetops, etc.) may be able to be coupled directly to the DC bus 110. However, such appliances 120 generally include electromechanical switches that require the current to drop to zero frequently (as occurs with an alternating current) to extinguish the arc that develops at the electromechanical switch's contacts. The arc generally needs to be extinguished at 100-120 Hz. If the current never drops to zero, the sustained arc at the contacts burns the contacts and may weld the contact closed. A sustained arc may also deposit an excessive amount of slag on the contact, preventing the contact from closing properly.

Figure 2A:
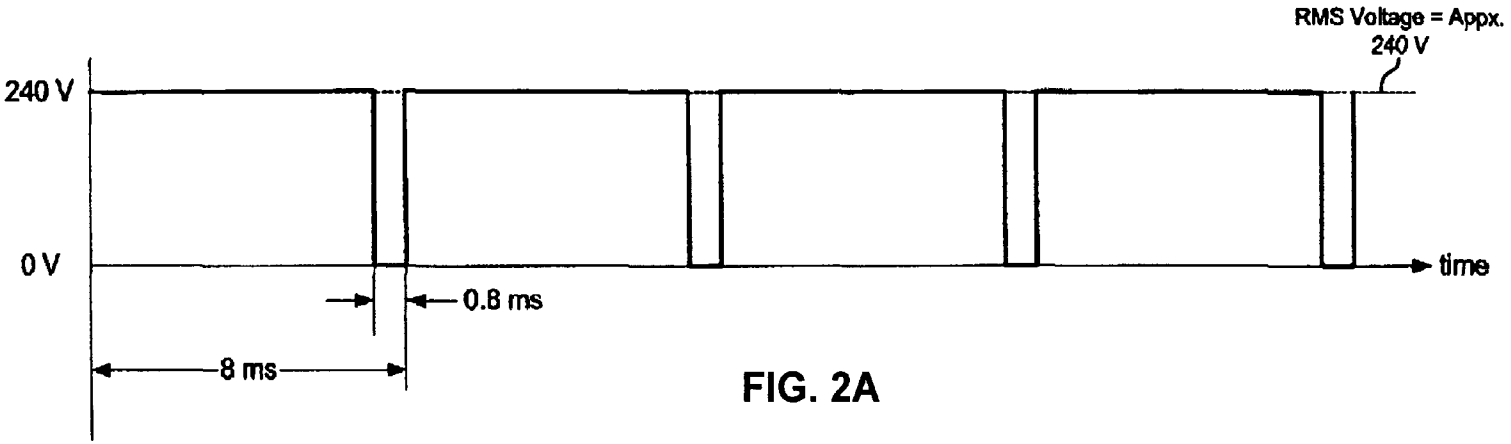
FIGS. 2A and 2B are graphs showing the voltage over time applied to an appliance coupled to the electrical system of FIG. 1 according to two exemplary embodiments.
Figure 2B:
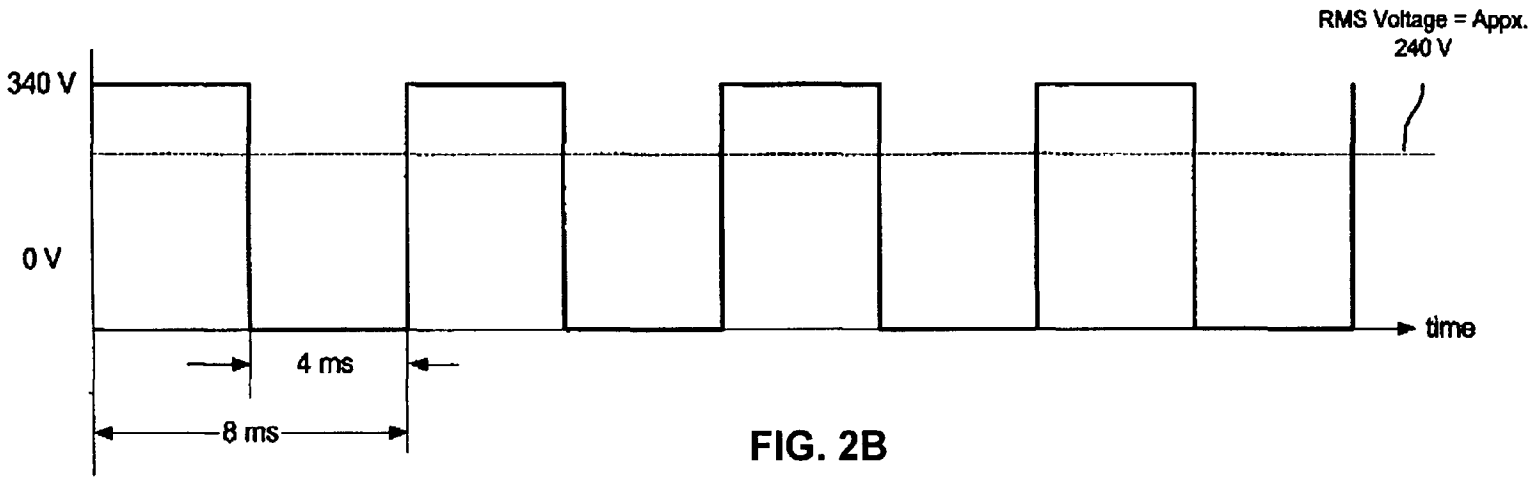

As shown in FIG. 1, a protection device 130 may be provided between an appliance 120 and the DC bus 110 to allow the appliance 120 to operate using DC power. According to one exemplary embodiment, the appliances 120 are normally configured to operate on 240 V AC power. The appliances 120 are adapted for use with 240 V DC power with a protection device 130. As shown in FIGS. 2A and 2B, the protection device 130 periodically (e.g., between 100 Hz and 120 Hz) interrupts the current to the appliance 120 to extinguish the arc that develops at the contacts of the electromechanical switch, allowing the switch to open without damaging itself.

Figure 3:
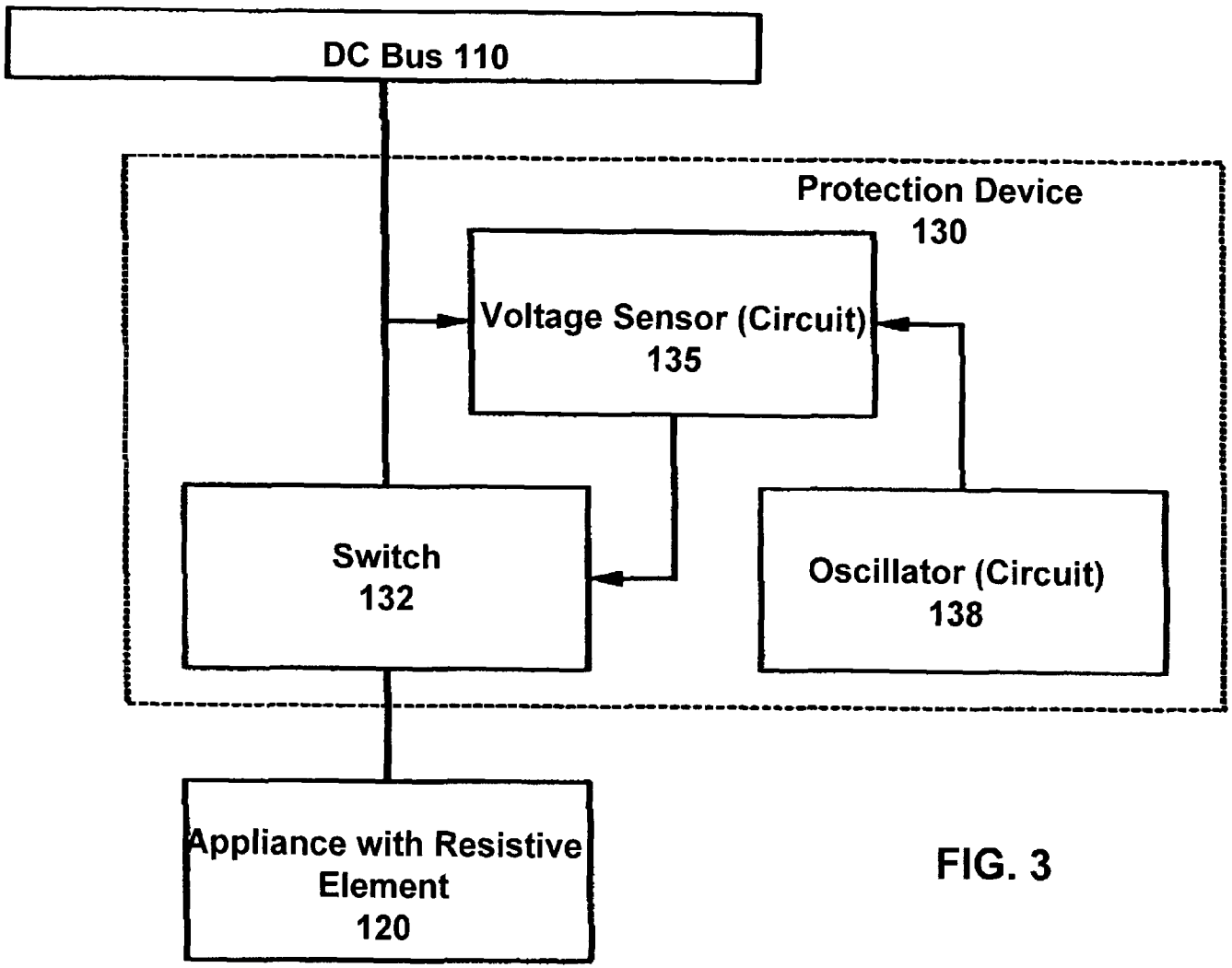
FIG. 3 is a block diagram of a protection device for the electrical system of FIG. 1 according to one exemplary embodiment.

Referring to FIG. 3, a block diagram of a protection device 130 is shown according to one exemplary embodiment. The protection device 130 includes a switch 132, an oscillator 138, and a voltage sensor 135. The switch 132 may be, for example, a single insulated-gate bipolar transistor (IGBT) that is driven by a simple oscillator circuit 138. The switch 132 holds the current off for a period of time for each cycle. The amount of time the current is held off is determined by the DC voltage, sensed by a voltage sensor circuit 135. The oscillator 138 and voltage sensor 135 circuits can be any number of a different designs well known to those skilled in the art. An exemplary detailed circuit diagram of the protective device 130 is shown in FIG. 5 of U.S. Provisional Patent Application No. 61/064,283.

Operation of the system is now described with reference to FIGS. 2A and 2B. Under normal operation the DC bus 110 is at 240 V DC and the appliance 120 is configured to operate at 240 V AC. In this normal situation, the protection device 130 simply has to interrupt the current for a short period (e.g., 800 μS at 120 Hz) to extinguish the arc, as described above and shown in FIG. 2A. Thus, an effective voltage seen by the device is actually less than 240 V due to the period of time when the voltage is zero. However, the electrical system 100 of the vessel may occasionally be powered by outside sources, such as shore power 108 when the vessel is docked. Typical European shore power operates at 240 V AC. As shown in FIG. 1, a 240 V AC shore power source 108*a* or a 120 V AC shore power source 108*b* may be coupled to the vessel's 240 V DC bus via a dual voltage input isolation transformer 109 and rectifier 107.

Certain capacitive loads may be coupled to the DC bus 110. When coupled to 240 V AC shore power, 240 V is the root-mean square (RMS) value of the AC voltage rectified via a rectifier 107. However, the rectified voltage may actually reaches peaks of approximately 340 V. The capacitive loads attached to the DC bus will store a charge at the maximum voltage to which the capacitors are exposed. As a result, the capacitors effectively make a 240 V DC bus into a 340 V DC bus. To compensate for the increased voltage, and the potential for damage resulting from the higher than normal voltage, the protection device 130 is configured to sense the voltage of a DC bus 110 and increase the amount of time the current is held off, as shown in FIG. 3B. Increasing the off time allows the RMS voltage applied to the resistive element of the appliance 120 to remain relatively constant and helps prevent the resistive element from overheating and becoming damaged. Thus, even though the switch is open for different periods of time in FIGS. 2A and 2B, the effective voltage applied to the appliance is the same.

Because resistive heaters do not require a voltage that reverses itself, the protection device 130 does not need to function as an inverter and can instead be a simplified device that periodically interrupts the current to the appliance 120 with a single switch. The protection device 130 allows a predominantly DC electrical system on a vessel to be adapted for use with conventional off the shelf AC appliances. The protection device 130 is provided as a separate component so the appliances 120 themselves do not need to be altered, which could potentially void any warranties on the appliances. The protection devices 130 may be added to existing vessels, adapting the electrical systems without physically altering the existing system.

While the electrical system 100 described above is generally referred to as a 240 V DC system, it should be understood that the protection device 130 is equally as effective at other voltages, such as 120 V.

It is important to note that the construction and arrangement of the power distribution system as shown in the various exemplary embodiments is illustrative only. Although only a few embodiments of the present application have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the application. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The foregoing description of embodiments of the application has been presented for purposes of illustration and description. It is not intended to be exhaustive or to limit the application to the precise form disclosed, and modifications and variations are possible in light of the above teachings, or may be acquired from practice of the application. The embodiments were chosen and described in order to explain the principles of the application and its practical application to enable one skilled in the art to utilize the application in various embodiments and with various modifications as are suited to the particular use contemplated.

Although the description contains many specificities, these specificities are utilized to illustrate some of the preferred embodiments of this application and should not be construed as limiting the scope of the application. The scope of this application fully encompasses other embodiments which may become apparent to those skilled in the art. All structural, chemical, and functional equivalents to the elements of the above-described application that are known to those of ordinary skill in the art are expressly incorporated herein by reference and are intended to be encompassed by the present application. A reference to an element in the singular is not intended to mean one and only one, unless explicitly so stated, but rather it should be construed to mean at least one. Furthermore, no element, component or method step in the present disclosure is intended to be dedicated to the public.

What is claimed is:

1. A power distribution system comprising:

a DC bus supplied by an electrical generator;

a resistive load connected to the DC bus; and a switching device connected to the DC bus and the load, wherein the switching device is configured to periodically open the circuit between the resistive load and the DC bus for a reoccurring period of time, and wherein the switching device senses the load on the DC bus and changes the length of the period of time based on the sensed voltage.

2. The system of claim 1, wherein the switching device is configured to maintain an effective voltage supplied to the resistance load at a substantially constant value.

3. The system of claim 2, wherein the switching device is configured so that the period of time that the switching device opens the circuit between the resistive load and the DC bus is always greater than or equal to a minimum length of time.

4. The system of claim 3, wherein the voltage supplied to the resistance load is 240 volts.

5. The system of claim 4, wherein the minimum length of time is about 0.8 milliseconds.

6. The system of claim 4, wherein the voltage supplied from the DC bus is 340 volts.

7. The system of claim 6, wherein the minimum length of time is about 4 milliseconds.

8. The system of claim 1, wherein the load includes at least one electromechanical switch designed to operate with an AC power supply.

9. A power distribution system for a marine vessel comprising:

a DC bus configured to be supplied by either an electrical generator or a rectified output from an AC power source, wherein the DC bus is configured to supply power to an appliance including a resistive heating element, the appliance being connected to the DC bus via an electromechanical switch including two contacts, wherein the electromechanical switch is designed to operate with an AC power supply;

a switching device connected between the DC bus and the appliance, wherein the switching device is configured to periodically open the circuit between the resistive load and the DC bus for a reoccurring period of time in order to quench an arc forming between the contacts of the electromechanical switch; wherein the switching device is configured to sense the load on the DC bus and changes the length of the period of time based on the sensed voltage.

10. The system of claim 9, wherein the switching device is configured to maintain the effective voltage supplied to the resistance heating element at a substantially constant value.

11. The system of claim 10, wherein the switching device is configured so that the period of time that the switching device opens the circuit between the resistive heating element and the DC bus is always greater than or equal to a minimum length of time.

12. The system of claim 11, wherein the voltage supplied from the DC bus to the resistive heating element is 340 volts.

* * * * *